United States Patent [19]

Segale et al.

[11] 3,995,407

[45] Dec. 7, 1976

[54] MACHINE FOR PACKAGING PRODUCTS TO BE PRESERVED UNDER VACUUM OR ATMOSPHERE OF SUITABLE GASES

[76] Inventors: Luigi Segale, Via Nullo 5, Caravaggio (Bergamo); Pier Enrico Passerini, Via Arco 13, Rho (Milan), both of Italy

[22] Filed: Nov. 3, 1975

[21] Appl. No.: 628,380

[30] Foreign Application Priority Data

Nov. 12, 1974 Italy ..... 29328/74

[52] U.S. Cl. ..... 53/112 A

[51] Int. Cl.[2] ..... B65B 31/08

[58] Field of Search ..... 53/22 A, 112 A

[56] References Cited

UNITED STATES PATENTS

| | | | |
|---|---|---|---|
| 2,387,812 | 10/1945 | Sonneborn et al. | 53/22 A |
| 2,861,406 | 11/1958 | Holsman et al. | 53/112 A X |
| 3,673,760 | 7/1972 | Canamero et al. | 53/22 A |

*Primary Examiner*—Travis S. McGehee

[57] ABSTRACT

Machine for packaging products under vacuum or inert gas atmosphere, comprising means for wrapping the product with sheet material, generally thermoplastic material, means for longitudinally sealing the material, means for carrying out transverse seals, means for perforating the sheet material and evacuating air from the package and possibly injecting inert gas, and means for carrying out a further transverse seal to insulate the hole.

8 Claims, 18 Drawing Figures

MACHINE FOR PACKAGING PRODUCTS TO BE PRESERVED UNDER VACUUM OR ATMOSPHERE OF SUITABLE GASES

This invention relates to a machine for packaging products, such as foodstuffs or the like, which are to be preserved under vacuum or atmosphere of suitable gases and, particularly, inert gases.

Such a machine is of the type using flexible sheet material, particularly a film of suitable synthetic resins, generally thermoplastic resins, which film will wrap the product for packaging.

An essential feature of a machine according to the present invention is that means are provided for carrying out a longitudinal seal between two sheet zones brought close to each other, means for carrying out transverse seals to close the package, means for evacuating air from the package and/or injecting suitable gas into the package, comprising a sheet piercing needle and means for carrying out following air evacuation and/or gas injection a further seal at such a location that the needle produced perforation is isolated, or is out of communication with the interior of the package.

In order that these and further remarkable features of the machine according to the present invention be more clearly understood, an embodiment of a machine according to the invention will now be described with reference to the accompanying drawings in which.

Figure 1:
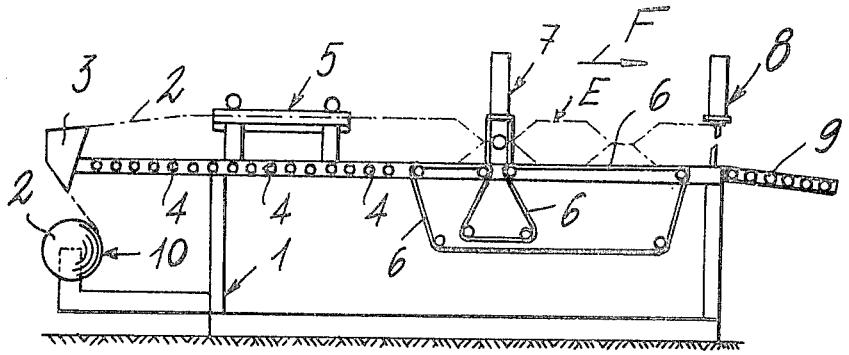
FIG. 1 is a diagrammatic elevational view of the machine according to the invention.
Figure 2:
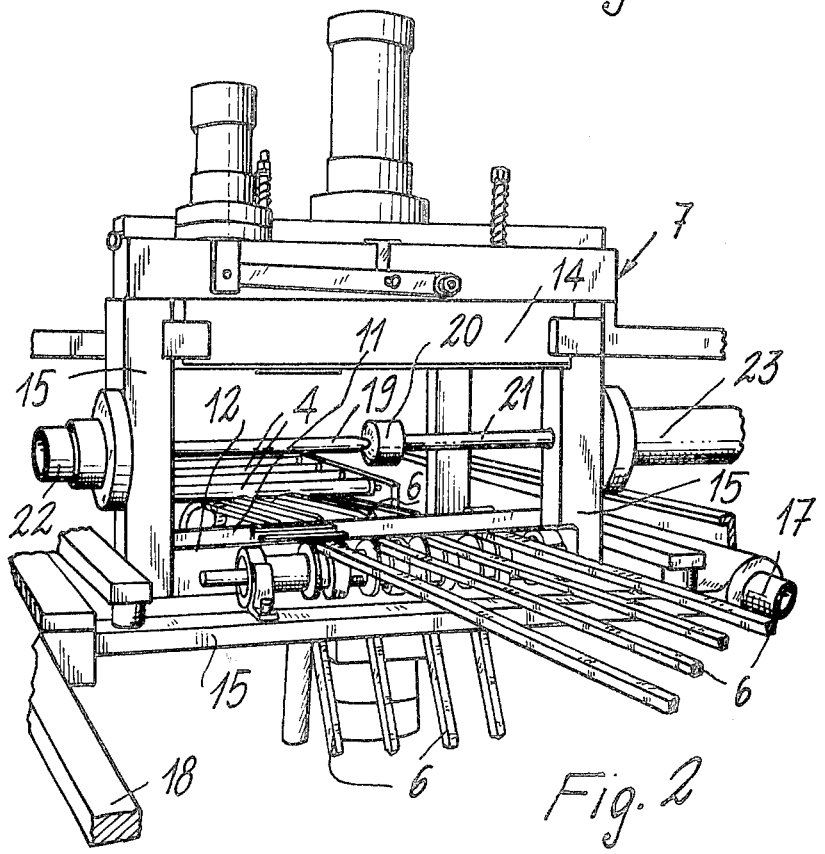
FIG. 2 is a perspective view showing a detail of the machine.

A machine, as shown in FIGS. 1 to 8, comprises a frame, designated as a whole at 1, carrying at position 10 a reel or roll of sheet material 2, substantially comprising a comparatively thin sheet of thermoplastic resins for packaging the products, such as foodstuffs. For instance, sheet 2 may comprise one or several layers. For example, one layer includes a cellophane type of material with the addition of a sheet of polythene or resins and the like; another material may comprise a sheet of polyester with the addition of polythene or the like; and similarly a material may comprise polyamide with the addition of polythene or the like. Units may be provided as obtained by bell or slot die coextrusion. Aluminum base coupled materials may be provided for sterilizing products and further various materials.

Similarly, for providing a sheet, other materials can be used, such as the following.

Mono- or bi-oriented plastic materials can be used as coupled with polyethylene or like resins, and the use is also provided for non-oriented carriers coupled with ionomeric polyolefines, simple or somewhat modified polyolefines, both with vinyl polymers in any percentage, and with the addition of external agents, such as stabilizers, plasticizers, U.V. protectants, products according to technologies commonly referred to as EXTRUSION - COATING, EXTRUSION - LAMINATION, ADESIVE LAMINATION, COEXTRUSION COATING or CAST, anyhow provided both in bell extrusion process or slot die extrusion process.

Reference numeral 3 designates a shaped element, fast with frame 1 and against which sheet 2 will slide, thus being given thereto a first shaping or concavity, in which the product is inserted. At position 5, a per se known device not forming part of the present invention is provided for carrying out a first seal in a longitudinal direction, as better explained hereinafter. Reference numeral 7 designates as a whole a device for both carrying out two seals and evacuating air or injecting gas into the package, whereas a cutter is provided at 8. Idle rotable rollers 4 are also provided and also a moving powered belt 6 is provided. Further idle rotable rollers 9 are provided downstream of said cutter 8.

The machine substantially operates as follows.

Figure 6:
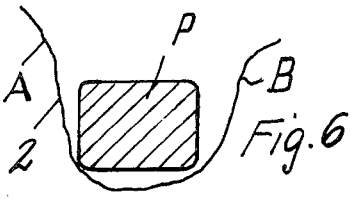
FIG. 6 is a view showing a detail of wrapping the sheet material on the product to be packaged.
Figure 7:
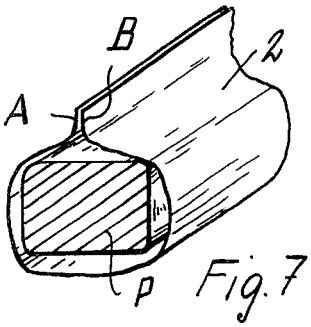
FIG. 7 shows a similar detail, in which a first (longitudinal) seal has been carried out.
Figure 8:
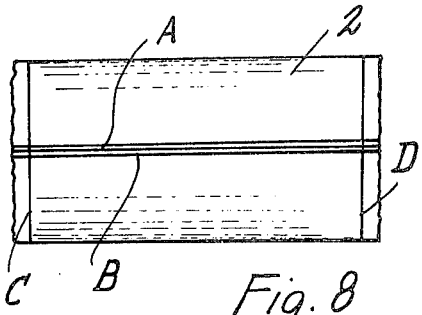
FIG. 8 is a plan view showing the finished package.

On contacting shaped rigid element 3, the material strip 2 unwinding from reel 10 will receive a first bend, so that said strip will assume some concavity substantially as schematically shown in FIG. 6. Immediately downstream of said bending element 3, product P is inserted, or is placed on strip 2 within said formed concavity. Following insertion of product P, a longitudinal seal will be carried out by device 5, or substantially the two zones A and B of sheet 2, suitably moved near each other (see FIG. 7) are sealed to each other. As apparent, product P encircled by thermoplastic strip 2, after said longitudinal seal does not yet form a closed envelope, but requires transverse seals, the latter being provided (see FIG. 8) just along transverse lines C and D. Strip 2 wrapping up the product with portions A and B sealed to each other passes at device 7.

More particularly, such a device 7 comprises a frame 15 moving on fixed parallel longitudinal guides 17 and 18. At the bottom said frame 15 has two electrodes 11 and 12 that are fixed relative to the frame. Provision is also made for two electrodes 13 and 14 carried from frame 15 by means enabling vertical movements for the two electrodes 13 and 14 relative to said frame 15. This frame 15 carries at least one hollow needle, or extractor or nozzle 19 operable by a cylinder 22. The cavity or bore of needle 19 communicates with an air evacuating pump. Frame 15 also carries a rod 21 having a body member 20, against which the tip of needle 19 is pressed. Rod 21 is operable by a further pneumatic cylinder 23.

Figure 3:
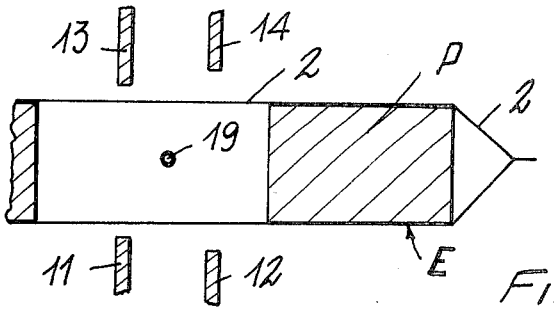
FIG. 3 is a sectional view showing a detail relating to both sealing means and air evacuating and/or gas injecting means at a determined stage.

Consider the package designated as a whole at E in FIGS. 1, 3, 4 and 5. In FIG. 3, as well as in FIG. 4, said package is being formed, while being substantially finished in FIG. 5.

Figure 4:
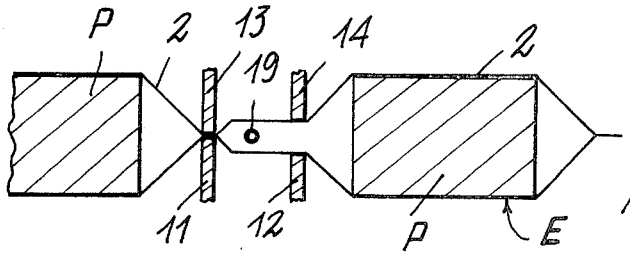
FIG. 4 is a view similar to that of FIG. 3, but at a successive stage.
Figure 5:
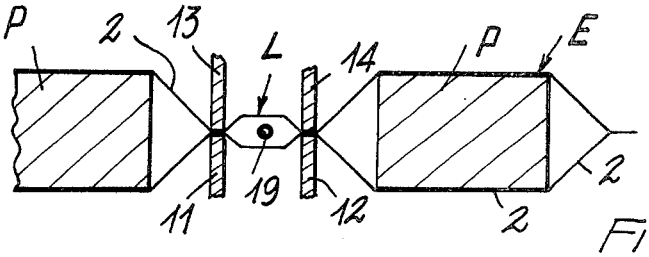
FIG. 5 shows the same detail as FIGS. 3 and 4, at a next stage to that of FIG. 4.

Firstly, in said device 7, the two electrodes 13 and 14 are at raised position, as shown in FIG. 3. Then, these electrodes 13 and 14 are downward moved, and particularly electrode 13 presses film 2 against the bottom electrode 11, that is two sides or faces of said film are pressed against each other, thus achieving a good air sealing. Needle 19 is now forward moved and pierces said film 2, in this operation the needle tip then presses against said body member 20. As shown in FIG. 3, 4 and 5, the right side portion of package E is already closed and this for reasons better explained hereinafter.

Following perforation of film 2 by said needle 19, air evacuation is started, thus providing vacuum within package E. Device 7 corporally moves in the direction of arrow F shown in FIG. 1, while air suction is continued. At some time, also electrode 14 terminates its downward movement. The two electrodes 11 and 13 provide a seal and the two electrodes 12 and 14 also provide a seal, thus meeting the conditions shown in FIG. 5.

From the foregoing, it will be apparent that the hole in film 2, as provided by needle 19 having sucked air or injected inert gas, is isolated, that is, after sealing accomplished by electrodes 12 and 14, said hole is no longer in communication with the interior of package E, in which product P is at vacuum or inert gas atmosphere condition.

Cutter 8 provides for cutting film 2 at said hole made by needle 19, that is at zone L. Device 7 moves back in a direction opposite to that of arrow F and the cycle is repeated, that is the assembly is at the conditions shown in FIG. 3. As apparent, on the right side of this FIG. 3, the package is sealed as caused in the preceding cycle by electrodes 11 and 13.

Seals caused by said electrodes tightly close the package along said lines C and D. The above described machine is horizontally arranged, but it is to be understood that the machine can be vertical or elsewise oriented.

According to a possible modified embodiment (see FIG. 9), a device is provided for sealing and evacuation, the device being designated by reference 7A at a stationary station and which may be similar to the above described device 7.

Also in this case, two electrodes, such as electrodes 11 and 13 of FIGS. 3, 4 and 5, carry out a seal, the film is then perforated and air evacuated and/or inert gas is injected. Two electrodes, such as electrodes 12 and 14, also carry out a seal, in this case attaining a situation as that shown in FIG. 5, then cutting at zone L.

Since transverse sealing and evacuating station is stationary, means are provided for drawing the material, that is the package and film remainder.

Figure 9:
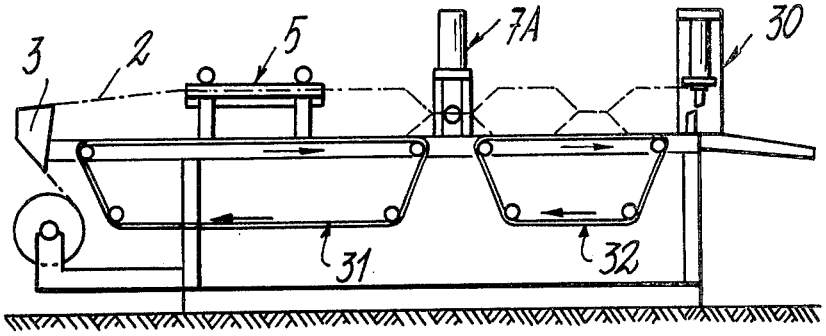
FIG. 9 shows a modified machine.

The cutter for cutting the material at said zone L can be provided at a next station, such as that shown at position 30 in FIG. 9.

In the example shown in FIG. 9, strip 2 is also bent by a shaped rigid element 3, as in the preceding example, and a device 5 is also provided for sealing the two sheet portions A and B, just as in the preceding example.

Conveyor belts, such as conveyor belts 31 and 32, are instead provided for drawing the material.

Figure 10:
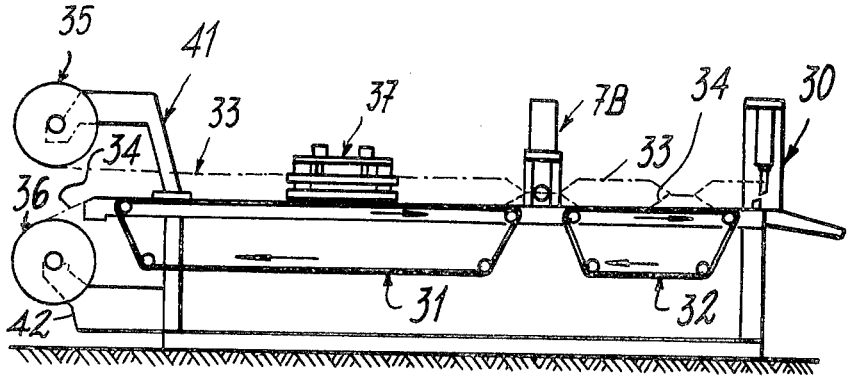
FIG. 10 shows a further modified embodiment of a machine according to the invention.

A further modified form, shown in FIG. 10, contemplates the use of two sheets or films 33 and 34, respectively, unwinding from the reels located at 35 and 36, respectively, carried by bearings 41 and 42.

In this embodiment of FIg. 10, a device 37 is provided for carrying out two longitudinal seals connecting the two sheets 33 and 34 on two opposite sides, product P being placed therebetween.

Figure 11:
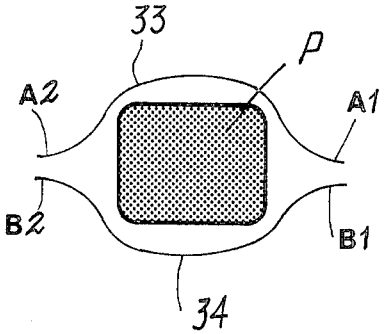
FIGS. 11 to 14 show some stages for packaging a product by the machine shown in FIG. 10.
Figure 12:
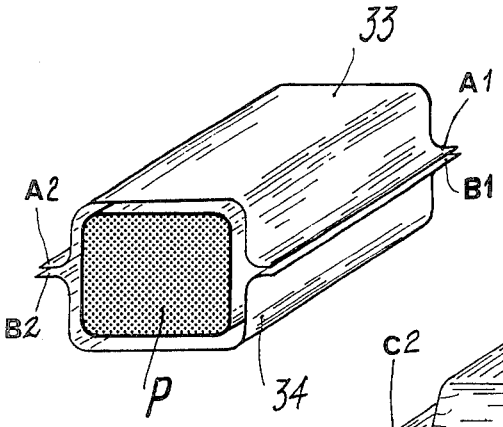

FIG. 11 shows product P placed between said sheets 33 and 34, whereas references A1 and B1 designate two edges of said sheets which are to be sealed, and references A2 and B2 designate the other two edges which are also to be sealed to each other. Said sheets 33 and 34, on which the two longitudinal seals are to be carried out, are also shown in a perspective view in FIG. 12, with product P inserted therebetween.

Downstream of device 37, a device 7B is provided which, as said device 7A, carries out the two transverse seals with air evacuation. In the example of FIG. 10 a cutter 30 is also provided and belts 31 and 32 are provided as in the example of FIG. 9.

Figure 13:
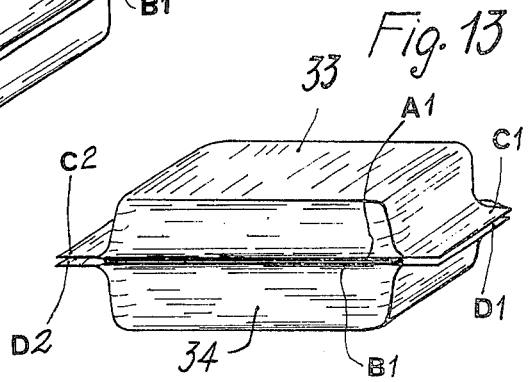

FIG. 13 shows two edges C1 and D1 which are also transversely sealed to each other, and C2 and D2 are the other two edges of sheets 33 and 34, which are also transversely sealed to each other.

Transverse seal between edges C1 and D1 and edges C2 and D2 is carried out by said device 7B.

Figure 14:
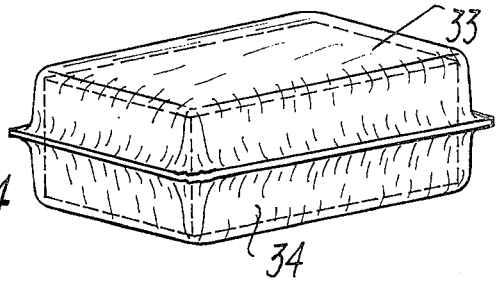

FIG. 14 is a practical view of a finished package, as carried out by the machine shown in FIG. 10.

Figure 16:
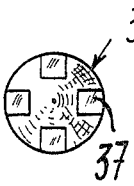
FIG. 16 shows the nozzle rotated through 90° relative to FIG. 15.
Figure 15:
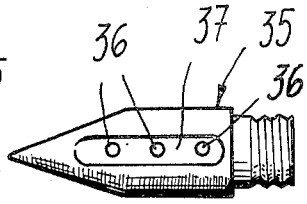
FIG. 15 is a view showing a nozzle for perforating a plastic sheet and air evacuating and/or inert gas injecting.

By mere way of example, the device suitable to pierce the film for air evacuation and/or inert gas injection, that is the nozzle, may be as that shown in FIGS. 15 and 16.

This nozzle 35 comprises side row-arranged holes 36. Each row of holes 36 is within a groove 37, so that even if bearing on the surface of nozzle 35, the film or sheet cannot obstruct said holes 36. Therefore, said nozzle will laterally suck air through holes 36.

There are products of a particular type having a substantial tendency to adhere to the plastic material film or sheet being used for packaging the product. In such a case, the film adherence to the product would be a serious obstacle to air evacuation from the package, due to the prevailing external atmospheric pressure. Thus, the invention provides suckers holding the film or sheet for a given period of time, while air evacuation is being carried out.

Figure 17:
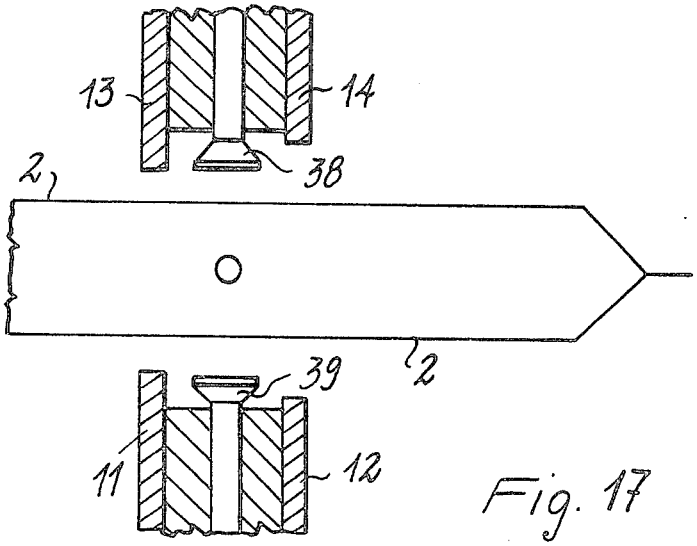
FIG. 17 shows a detail of a machine, in which the use of suckers is provided.
Figure 18:
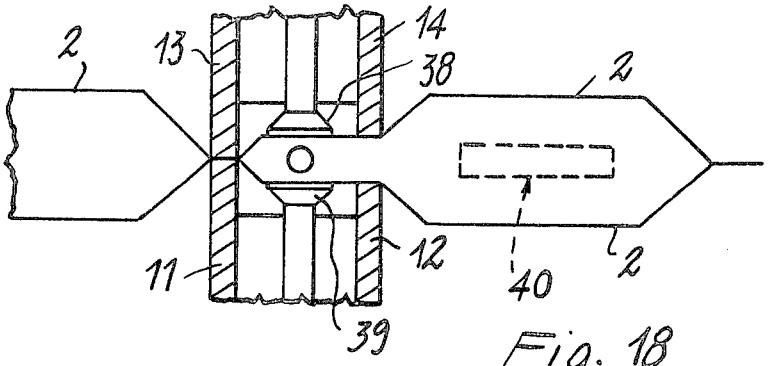
FIG. 18 shows a similar detail in a different configuration.

For example, in FIGS. 17 and 18, where the film or sheet is again designated by 2 as in the example of FIGS. 1 to 8, whereas the sealing electrodes are designated by 11, 12, 13 and 14 as in said FIGS. 1 to 8, two suckers 38 and 39, respectively, are shown.

Said suckers 38 and 39 hold the sheet (FIG. 18) as air is evacuated from the package.

Suckers could be also laterally provided, such as at the dashed line position shown at 40.

What we claim is:

1. A machine for packaging a product in a controlled atmosphere comprising:

means for wrapping the product with a length of flexible sheet material;

means for sealing the longitudinal edges of said material to form a package for the product;

means for carrying out a first transverse seal to close the package, including a pair of opposed sealing electrodes;

means for communicating with the interior of the package including a hollow needle piercing the sheet material to produce a hole therein and effect said controlled atmosphere;

means for carrying out a further transverse seal at such a position that the needle-produced hole is isolated between the two seals and not in communication with the package interior containing the product, said means for carrying out a further transverse seal including a second pair of opposed sealing electrodes;

guide means supporting said first and second transverse sealing means and said communicating means for longitudinal rectilinear movement thereof; and means for sequentially operating in order said first sealing means, then said communicating means, then said second sealing means while said first and second transverse sealing means and said communicating means move in a feed direction of said sheet material.

2. A machine according to claim 1, wherein said means for communicating includes a nozzle for piercing the sheet material, the nozzle having transverse holes passing therethrough, said holes arranged in rows parallel to the geometrical axis of the nozzle, each row of said holes being located in a corresponding longitudinal recess in said nozzle.

3. A machine according to claim 1, wherein said means for communicating includes means for evacuating the interior of the package.

4. A machine according to claim 1, wherein said means for communicating includes means for injecting a gas into the package.

5. A machine for packaging products in a controlled atmosphere, comprising:

means for wrapping the product with a length of flexible sheet material;

means for sealing the longitudinal edges of said material to form a package for a product;

means for carrying out a first transverse seal to close the package, including a pair of opposed sealing electrodes;

means for communicating with the interior of the package including a hollow needle piercing the sheet material to produce a hole therein and effect said controlled atmosphere;

means for carrying out a further transverse seal at such a position that the needle-produced hole is isolated between the two seals and not in communication with the package interior containing the product, said means for carrying out a further transverse seal including a second pair of opposed sealing electrodes;

means for sequentially operating in order said first sealing means, then said communicating means, then said second sealing means, said first and second transverse sealing means and said communicating means defining a fixed station; and means for conveying said sheet material to said station and for conveying the packaged product from said station, said conveying means including movable looped belts located upstream and downstream of said station.

6. A machine according to claim 5, wherein said means for communicating includes a nozzle for piercing the sheet material, the nozzle having transverse holes passing therethrough, said holes arranged in rows parallel to the geometrical axis of the nozzle, each row of said holes being located in a corresponding longitudinal recess in said nozzle.

7. A machine according to claim 5, wherein said means for communicating includes means for evacuating the interior of the package.

8. A machine according to claim 5, wherein said means for communicating includes means for injecting a gas into the package.

* * * * *